US007861942B2

(12) United States Patent
Damon et al.

(10) Patent No.: US 7,861,942 B2
(45) Date of Patent: Jan. 4, 2011

(54) SEALED WATERFALL ASSEMBLY

(75) Inventors: Peri Damon, Windham, NH (US); Scott Neville, Windham, NH (US)

(73) Assignee: Rock'n Crab Aquatics, Windham, NH (US)

( * ) Notice: Subject to any disclaimer, the term of this patent is extended or adjusted under 35 U.S.C. 154(b) by 563 days.

(21) Appl. No.: 11/404,371

(22) Filed: Apr. 14, 2006

(65) Prior Publication Data

US 2007/0125872 A1 Jun. 7, 2007

Related U.S. Application Data

(60) Provisional application No. 60/741,427, filed on Dec. 1, 2005.

(51) Int. Cl.
*E03B 9/20* (2006.01)
*B05B 17/08* (2006.01)
*F21S 8/00* (2006.01)

(52) U.S. Cl. ..... 239/18; 239/16; 239/17; 239/20; 239/22; 239/23

(58) Field of Classification Search ..... 239/16, 239/17, 18, 20, 22, 23
See application file for complete search history.

(56) References Cited

U.S. PATENT DOCUMENTS 6,279,835 B1 * 8/2001 Hansen ..... 239/20
6,311,898 B1 * 11/2001 Gruff ..... 239/17
6,634,138 B2 * 10/2003 Katzman ..... 47/79
6,695,221 B2 * 2/2004 Lussier ..... 239/17
6,971,586 B2 * 12/2005 Fisher ..... 239/17
7,073,728 B2 * 7/2006 Watson et al. ..... 239/20
7,267,455 B2 * 9/2007 Chernoff et al. ..... 362/253

FOREIGN PATENT DOCUMENTS

FR 2625116 A1 * 6/1989

* cited by examiner

*Primary Examiner*—Len Tran
*Assistant Examiner*—Ryan Reis
(74) *Attorney, Agent, or Firm*—Bourque & Associates, P.A.

(57) ABSTRACT

A waterfall assembly features a first, substantially hermetically sealed chamber adapted to contain a quantity of liquid. The first chamber includes at least one substantially vertical and transparent side having an internal surface, preferably with a plurality of protrusions. A pump or fluid transport device is in fluid communication with the first chamber and at least one nozzle/aperture disposed within the first chamber. The nozzle/aperture directs the liquid against at least a portion of the internal surface of the vertical side of the first chamber such that some of the liquid flows over the protrusions. A second chamber having a light source may be disposed beneath the first chamber for illuminating the first chamber.

11 Claims, 8 Drawing Sheets

SEALED WATERFALL ASSEMBLY

CROSS-REFERENCE TO RELATED APPLICATIONS

This application claims the benefit of U.S. Provisional Application Ser. No. 60/741,427, filed Dec. 1, 2005, the entirety of which is incorporated herein by reference.

TECHNICAL FIELD

The present invention relates to art fixtures and more particularly, relates to stand-alone water-based art fixtures and assemblies.

BACKGROUND INFORMATION

Due to their inherent beauty and soothing qualities, many people enjoy having waterfalls in their homes and business. For example, waterfalls and the like have been used as art pieces (similar to the location of a hanging picture or sculpture), as backdrops for Point-of-sale (POS) or Point-of-purchase (POP) units, for signage (example logo backdrop for corporate reception desk), as unique walls (dividers in offices—may or may not be see through), for effect (relaxation)—spas and salons, as attention gatherers—incorporated in trade show booths, in conference rooms or lobbies with signage near by, and as fixtures (incorporate lighting to light an area or enhance an area—over a table, behind a bar, in a table's stand, exterior finish to a counter area, etc.).

FIG. 1 shows an illustrative embodiment of a known waterfall design. The waterfall 1 according to this embodiment generally consists of a rectangular unit 2 having a pump (not shown) that pumps water over the generally vertical external surfaces 3. The water within the waterfall 1 is ultimately exposed to the environment. Consequently, the known waterfalls 1 suffer from several limitations.

One known limitation of the known waterfall designs 1 is that water can splash out of the unit 2 and onto nearby objects causing a safety hazard and damage. Another limitation of the known waterfalls 1 is that the foreign debris (bacteria, mold, and other objects) can be easily introduced into the water. In an effort to minimize these problems, the known waterfalls 1 may include water treatment. While these efforts reduce the amount of water that splashes out of the waterfall 1, the base 13 substantially increases the dimensions of the waterfall 1.

Additionally, the water within the waterfall 1 is open to the environment and tends to evaporate quickly (leaving behind minerals and deposits) and bacteria and mold are prone to grow. Consequently, the known open, exposed waterfall designs 1 are maintenance intensive and require cleaning the water surfaces, changing the water, adding water due to evaporation, prevention of water based diseases, as well as removing initial and continued water impurities and debris. While using chemical additives, adjusting flow rates, or using filtrations systems can mitigate some of these problems, these methods generally add considerable expense to the waterfall 1 and are only minimally effective.

Another known indoor waterfall design is generally referred to as a bubble panel 4, FIG. 2. The known bubble panel designs 4 do not pump water, but instead are filled with water 5 and have an air pump (not shown) that introduces bubbles 6 near the bottom 7 of the units 4. The bubbles 6 float up to the top 8 of the units 4. The top 8 of the bubble panel is not sealed and is open to the environment to allow the air released by the bubbles to escape. Consequently, the water 5 in the bubble panel 4 is exposed to the environment and suffers from many of the same problems of the known waterfalls 1 (FIG. 1). The bubble panel 1 does not have water flowing downward and instead is filled with water; consequently, the bubble panel 4 provides a completely different effect compared to the waterfall 1 (FIG. 1).

Accordingly, there exists a need for an improved waterfall system that has substantially all of the beneficial qualities of the known waterfall designs such as the visual effect and soothing properties, but without the disadvantages of the known devices. The improved waterfall system should preferably minimize water evaporation, bacterial and mold growth, the hazard of water on the ground and damage to surrounding objects, maintenance requirements, the introduction of debris, and/or mineral deposits. The device should also be easily installed and operated.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by the following claims.

SUMMARY

According to one embodiment, the present invention features a waterfall assembly including a first, substantially hermetically sealed chamber adapted to contain a quantity of liquid. The first chamber includes at least one substantially vertical side having an internal surface and an external surface. The internal surface may include a plurality of protrusion, preferably arranged in substantially horizontal rows. The internal surface is preferably substantially transparent, though it may also be substantially translucent.

A fluid transport system is in fluid communication with the first chamber and at least one aperture. The fluid transport system preferably includes either a pump or a plurality of capillary tubes optionally having at least one fluid reservoir. The pump may be disposed within the first chamber or alternatively may be remotely located. The aperture is disposed within the first chamber and directs a portion of the water against at least a portion of the internal surface of the substantially vertical side of the first chamber such that the water flows across at least part of the internal surface of the substantially vertical side.

The waterfall assembly may further include a second chamber disposed substantially beneath the first chamber. The second chamber includes a light source for illuminating at least a region of the internal surface. Optionally, a divider is disposed between the first and the second chambers. The divider allows light emitted from the light source to pass from the second chamber into the first chamber and through the substantially vertical side. The divider may include a tint to alter the color of the light emitted from the light source before it enters the first chamber. Alternatively, the second chamber may include a layer of colored, translucent material disposed between the light source and the divider.

According to another embodiment, the present invention features a waterfall apparatus comprising a hermetically sealed unit defining a cavity including at least one substantially transparent and vertical side having an internal surface with a plurality of protrusions. A fluid transport system is connected to the hermetically sealed unit and at least one aperture. The aperture is disposed within the cavity and is adapted to direct liquid from the pump towards an upper region of the internal surface of the side such that the liquid flows across the internal surface from the upper region towards a lower region of the internal surface.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
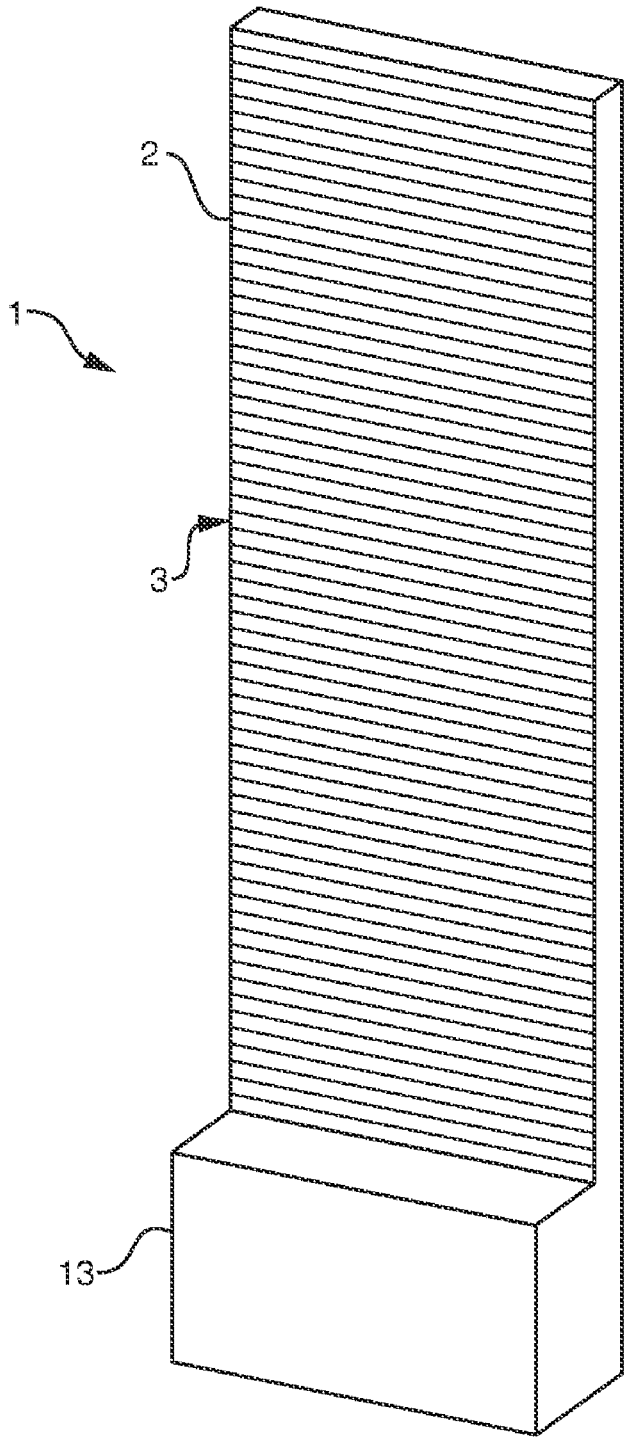
FIG. 1 (PRIOR ART)
FIG. 1 is an illustrative view of one embodiment of a prior art waterfall assembly.
Figure 2:
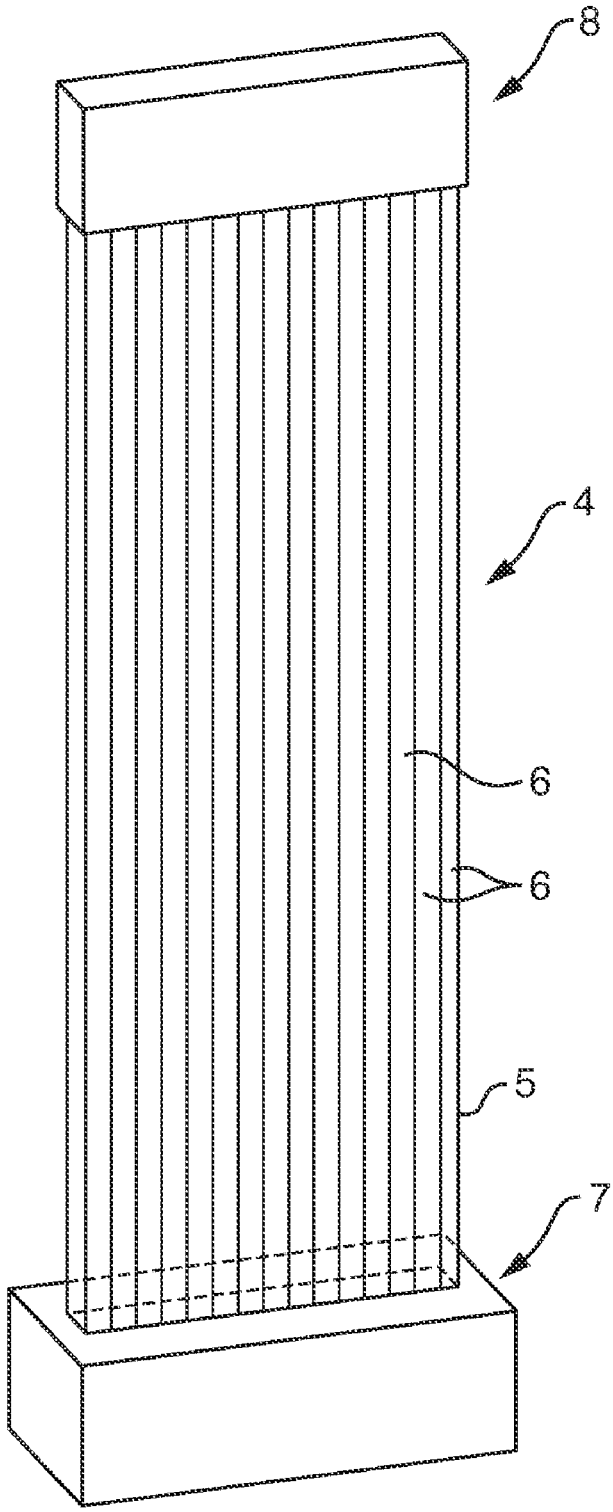
FIG. 2 (PRIOR ART)
FIG. 2 is an illustrative view of one embodiment of a prior art bubble panel assembly.

According to one embodiment, the present invention features a waterfall assembly 10, FIGS. 3-7, featuring a substantially sealed unit 12. As will be explained in greater detail hereinbelow, the waterfall assembly 10 directs the water 14 to flow over at least one internal surface 16 (FIG. 4) of the sealed unit 12 rather than the external surfaces 16 of the known waterfall designs 1 (FIG. 1). As a result, the water 14 within the waterfall assembly 10 is substantially hermetically sealed from the environment, thereby substantially eliminating many of the disadvantages and limitations of the known waterfall designs 1 (FIG. 1) while still maintaining the desired beneficial effects of the existing external waterfall units 1.

The waterfall assembly 10 may feature any shape known to those skilled in the art, but for illustrative purposes only, the waterfall assembly 10 may feature a generally rectangular shape. The waterfall assembly 10 preferably includes at least one wall 11 featuring the internal surface 16 that is substantially transparent. Optionally, the wall 11 may also feature a translucent material and may also include a color or tint. It should be noted that the waterfall assembly 10 according to the present invention does not need to have a large base 13 (FIG. 1) as required in the prior art waterfall designs 1 to prevent the water from escaping (which also allows a considerable amount of water to evaporate). As a result, the footprint of the waterfall assembly 10 according to the present invention may be substantially smaller compared to the known waterfall designs 1.

According to one embodiment of the present invention, the waterfall assembly 10 includes a fluid transportation device 32. In the preferred embodiment, the fluid transportation device 32 includes a pump 32 and preferably features sealed electrical connections 31 to allow the pump 32 to be connected at installation, thereby minimizing the amount of assembly required. The fluid transportation device 32 is preferably disposed within the sealed unit 12 proximate the bottom region 24 of the waterfall assembly 10 beneath the water level 13 and is in fluid communication with a water delivery assembly 40 via plumbing 42. In larger waterfall assembles 10, however, it may be beneficial to remotely locate the fluid transportation device 32. In either embodiment, it is important to keep the unit 12 (and the water 14) substantially hermetically sealed from the environment.

Figure 5:
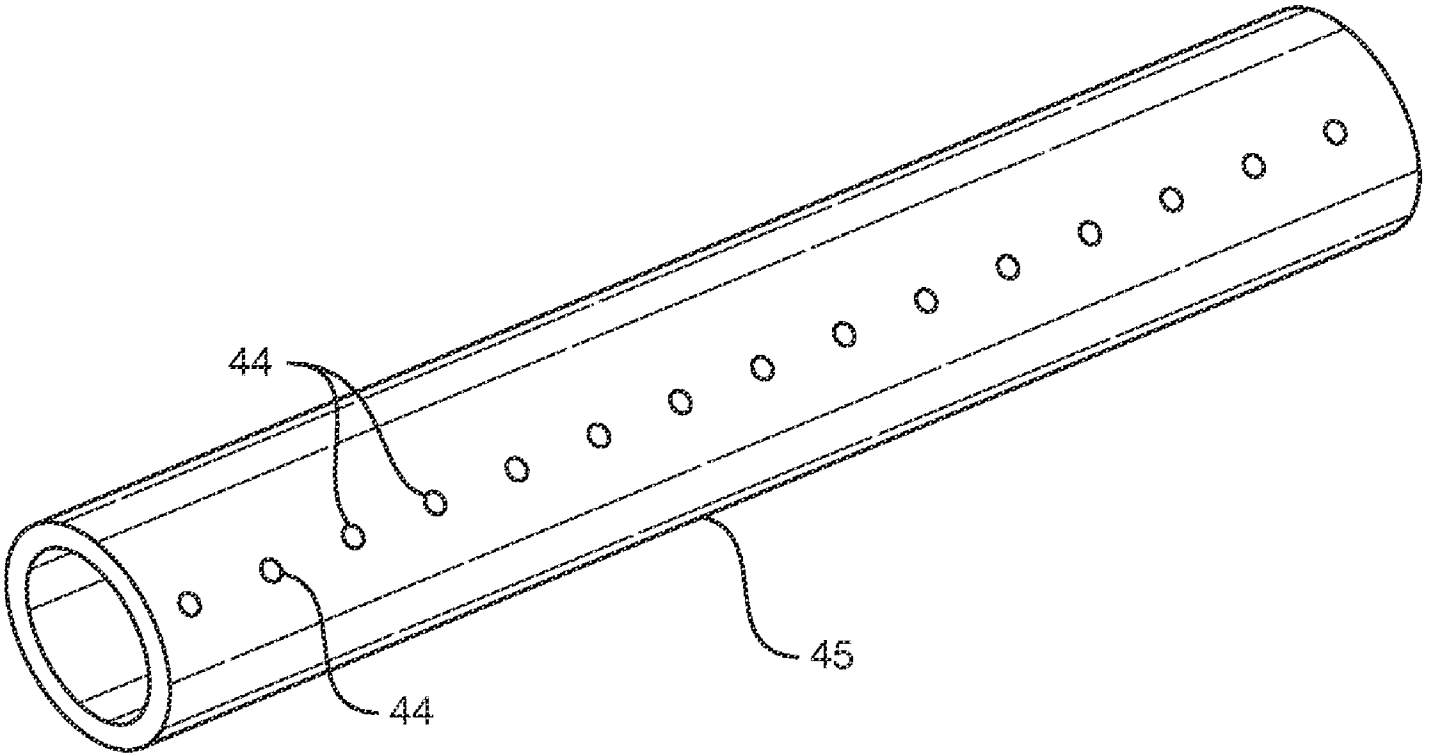
FIG. 5 is a front and back plan view of one embodiment of the water delivery assembly according to the present invention.
Figure 6:
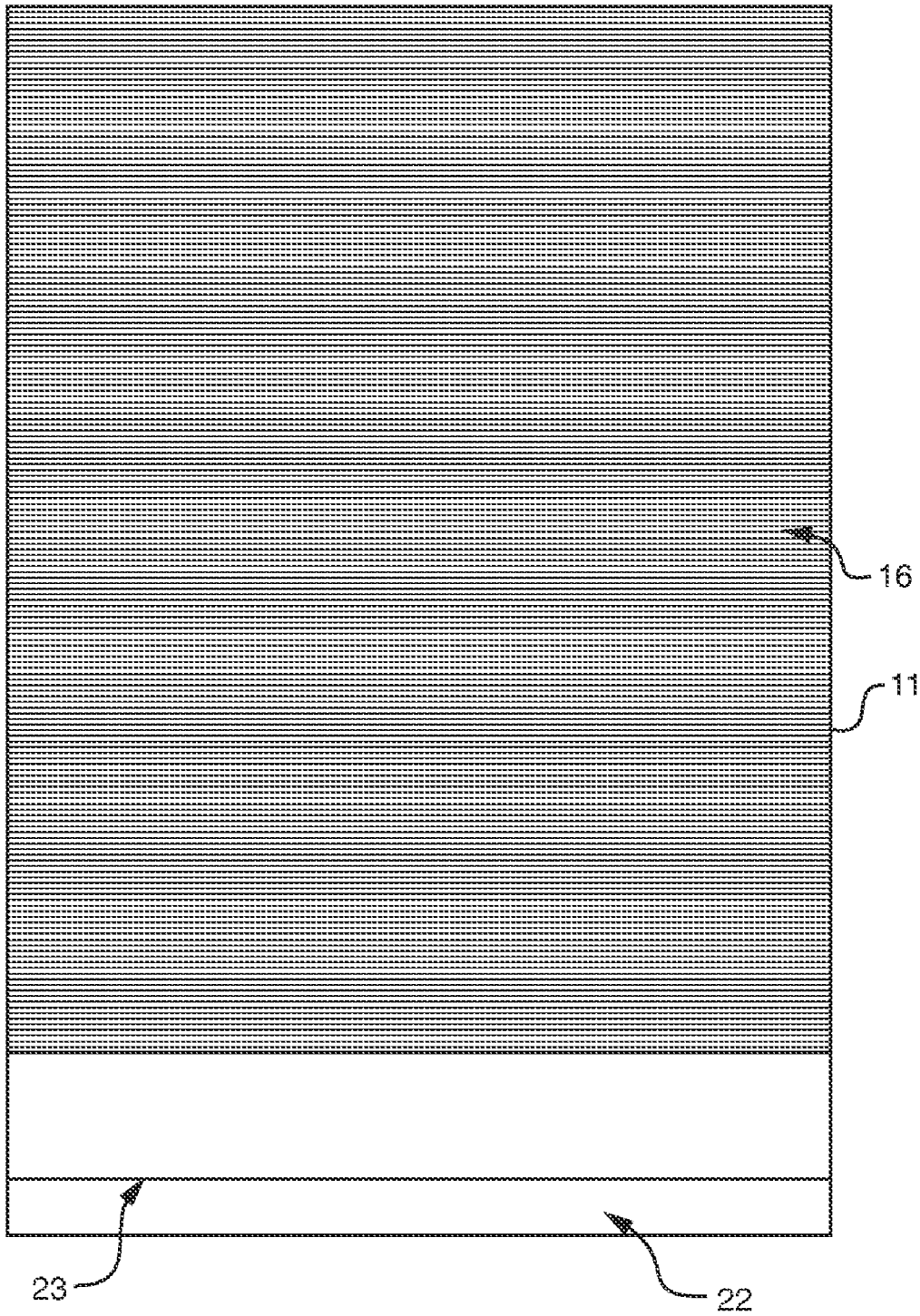
FIG. 6 front plan view of the waterfall assembly shown in FIG. 3.
Figure 7:
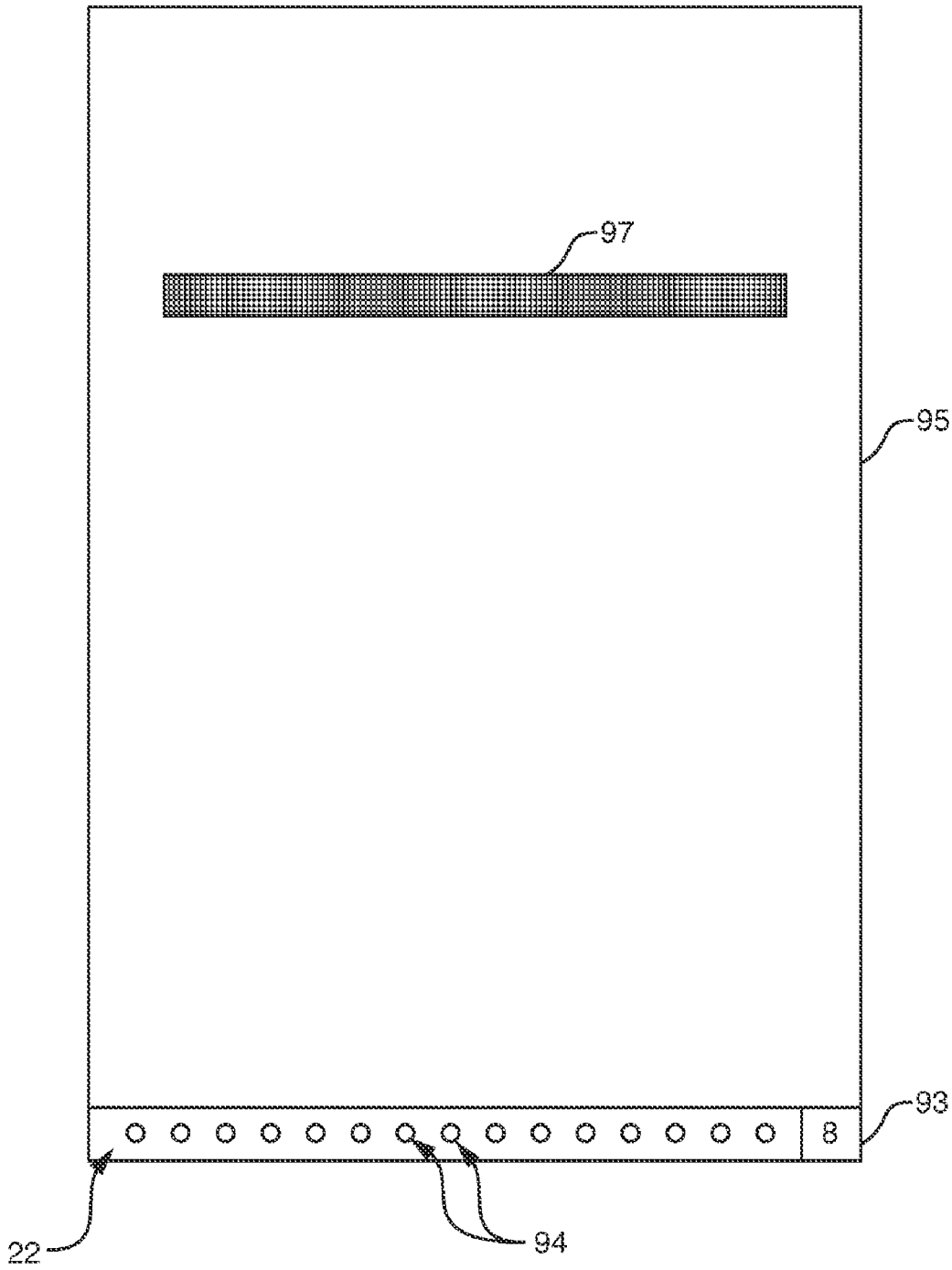
FIG. 7 back plan view of the waterfall assembly shown in FIG. 3.

The water delivery assembly 40, FIG. 5, is preferably located proximate a top region 15 (FIG. 3) of the sealed unit 12, preferably using a mounting bracket 47 (FIG. 4) or the like. The water delivery assembly 40 preferably features a plurality of apertures or nozzles 44 arranged longitudinally along at least one side of an elongated tubular member 45. The water delivery assembly 40 forms a manifold that directs the water 14 out of the apertures or nozzles 44 towards the internal surface 16 such that the water 14 preferably flows generally downward over the internal surface 16 from the top region 15 towards the bottom region 24. By varying the water flow rate and the nozzles 44 (for example, the location of the nozzles 44, the diameters of the nozzle 44, and the design of the nozzles 44), a substantially even flow can be achieved over the internal surface 16, though the flow of the water 14 does not have to be even. The flow of the water 14 over the internal surface 16 can be seen through the wall 11 thereby providing the desired effects. As a result, the waterfall assembly 10 according to the present invention provides substantially all the aesthetic benefits of the prior art waterfall designs 1.

In order to feature a sealed unit 12, the waterfall assembly 10 according to the present invention faced several unique problems that needed to be overcome such as, but not limited to, condensation and lighting. These problems required additional design considerations to obtain the final desired effect and accomplish eliminating the specific issues/problem objectives and will be explained in greater detail throughout.

The use of a sealed unit 12 in the waterfall assembly 12, however, substantially reduces or eliminates the maintenance required. The seal unit 12 eliminates the water 14 from being contaminated by both air borne debris and by physical (public) inputs. This allows the water 14 to stay clean eliminating the need to change water 14, the need to clean the water surfaces, or the need to use costly water filtration systems, or the need to use potentially dangerous chemicals. Distilled water 14 is preferably used to start the waterfall assembly 10 since it introduces minimum particulates.

The sealed unit 12 according to the waterfall assembly 10 also restricts/minimizes the growth of algae, bacteria and disease and reduces or eliminates the need for adding water due to evaporation. Because the waterfall assembly 10 features a sealed unit 12, water 14 cannot be removed also from the general public touching the water flow. Consequently, chemicals may be added to the water 14 to further reduce the growth of algae, bacteria, and disease without substantially increasing the danger to the public.

The sealed unit 12 according to the present invention prevents the public from being able to touch and remove the water 14 since the water 14 is disposed entirely within the interior region 18 of the sealed unit 12. Additionally, the use of a seals unit 12 prevents water 14 from splashing beyond unit 10, a problem that most known devices 1 (FIG. 1) suffer. As discussed above, water on the floor or near the unit can be a hazard leading to injury (slipping and falling) as well as damage to surround objects (such as, but not limited to, floor). External water on the floor is also a potential area for disease and debris to collect potentially causing health and visual issues.

Moreover, the waterfall assembly 10 according to the present invention does not need a large base 13 (FIG. 1) to reduce the water from splashing beyond the unit as required by the prior art waterfall designs 1. As a result, the footprint of the waterfall assembly 10 is substantially smaller, allowing the waterfall assembly to be more easily integrated into an area. Additionally, the lack of a large base 13 also facilitates hanging the waterfall assembly 10 on a wall. For example, the waterfall assembly 10, FIG. 7, may feature a mounting bracket 97 secured to a rear support 95 for hanging the waterfall assembly 10 to a wall or the like or a room.

The use of a sealed unit 12 also preserves the desired water surface effect. Sealing the unit 10 and redirecting the water retrieving and delivery surfaces allow the waterfall assembly 10 to obtain the desired external effect without the problems. The waterfall assembly 10 may optionally include fixtures, logos, and the like on the inside and/or outside surface 11 of the unit 12.

Figure 3:
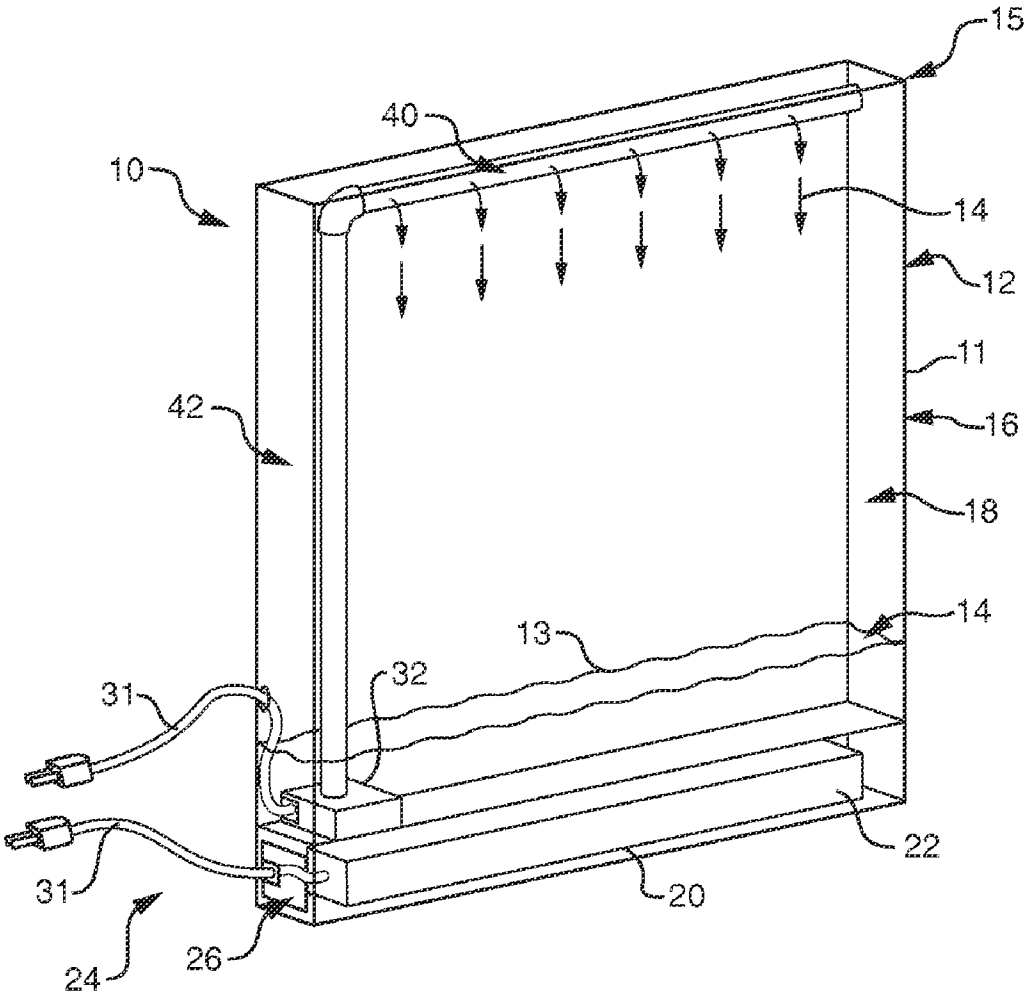
FIG. 3 is a perspective view of one embodiment of the waterfall assembly according to the present invention.
Figure 4A:
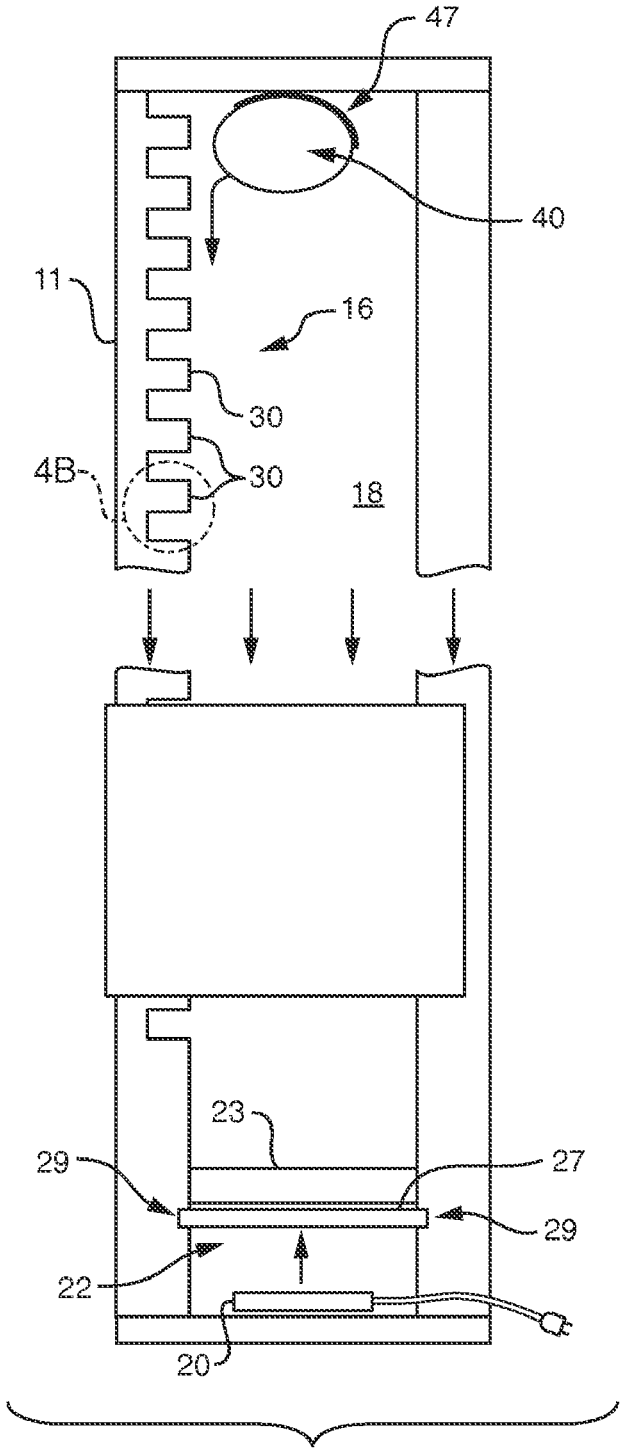
FIG. 4*a* is side perspective view of the embodiment shown in FIG. 3.
Figure 4B:
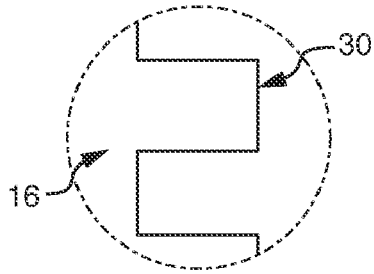
FIG. 4B is a close up of section 4B in FIG. 4A.

The waterfall assembly 10 optionally includes a lighting source 20, FIG. 3, having an electrical connection 31. In the preferred embodiment, the present invention 10 preferably features a separate water-tight chamber 22, FIGS. 3, 4*a*, 6, and 7. The water-tight chamber 22 is preferably disposed proximate the bottom region 24 of the sealed unit 12 and features a divider 23 disposed between the chamber 22 and the interior region 18 of the sealed unit 12 containing the water 14. Optionally, the chamber 22 may feature a cooling device such as, but not limited to, vent hole 94, FIG. 7, or a fan 93 for removing heat generated by the light source 20.

The divider 23 is preferably substantially transparent such that light emitted from the light source 20 can pass into the interior region 18 of the sealed unit 12 and ultimately through the wall 11. Optionally, the divider 23 may be provided with a color or tint to alter the color of the light emitted into the interior region 18 of the sealed unit 12 or alternatively the chamber 22 may be provided with a colored sheet 27 (FIG. 4*a*) which is secured within the chamber 22 (for example, but not limited to, within notches 29 sized and shaped to receive the colored sheet 27) to provide the same effect.

The chamber 22 also optionally includes an access port 26 to facilitate access to the lighting source 20. Placing the chamber 22 beneath the interior region 18 of the sealed unit 12 better replicates the effects of the prior art waterfalls 1 (FIG. 1). While placing the lighting source 20 beneath the interior region 18 of the sealed unit 12 is the preferred embodiment, the waterfall assembly 10, however, may alternatively feature a lighting source 20 that provides a backlighting effect, top lighting effect, and/or a side lighting effect.

In order to solve the problem of condensation, waterfall assembly 10 according to the present invention preferably features water 14 flowing over the front, inner surface 16. The present invention solves this problem by flowing water over the interior region 18 of the sealed unit 12. Since water 14 is flowing over the interior surface 16, the effects of condensation are substantially avoided.

In the preferred embodiment, the waterfall assembly 10 according to the present invention features an internal water surface 16 preferably having a non-planar surface with a plurality of raised regions 30. The water 14 flowing over the non-planar surface provides a pleasing visual effect. The Referring specifically to FIG. 4*b*, the internal surface 16 preferably features protrusions extending approximately ⅛" perpendicularly outwards from the internal surface 16 with a base region of approximately ¼" and a spacing of approximately ¼". The protrusions may be randomly spaced or set up in rows or columns. While these are the preferred dimensions, those skilled in the art will recognize that other dimensions are also possible. Alternatively, the internal water surface 16 may be generally smooth.

Figure 8:
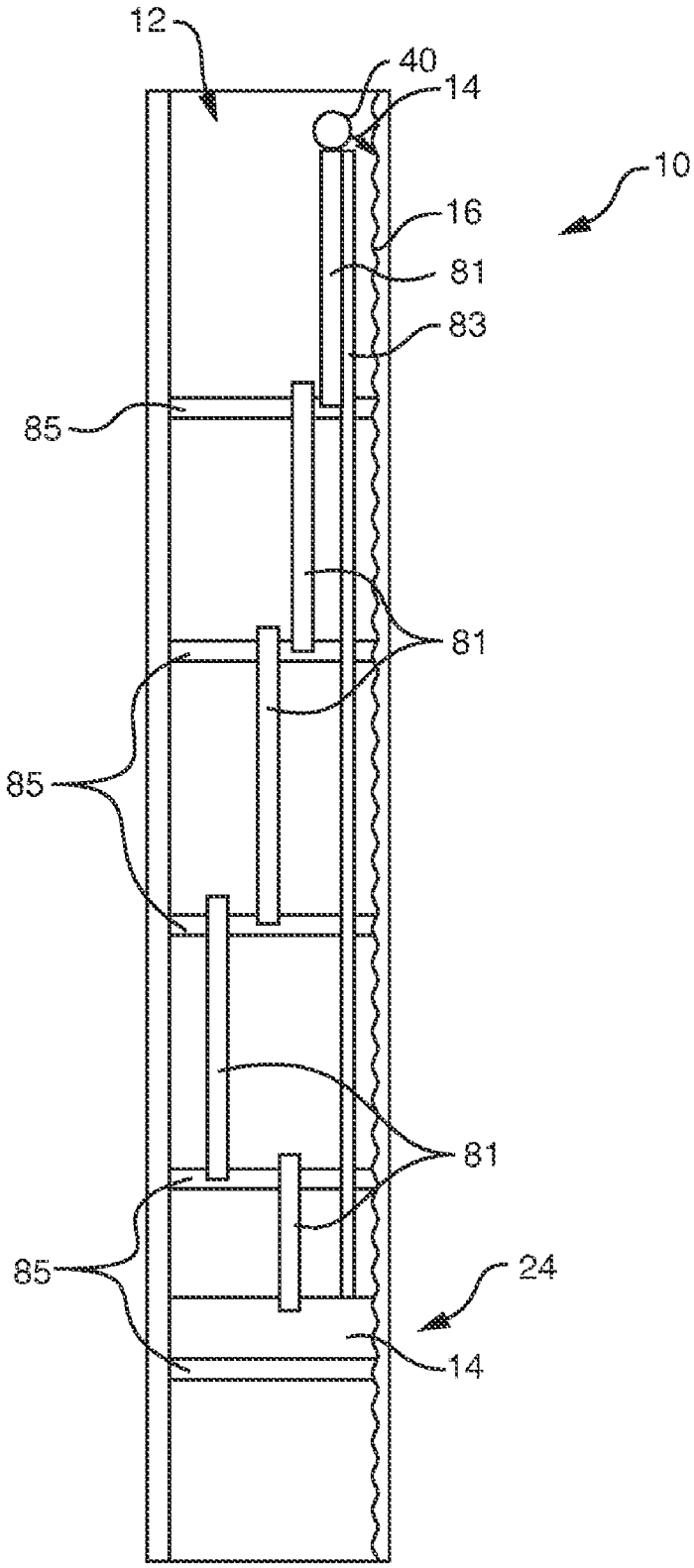
FIG. 8 is a side perspective view of another embodiment of the waterfall assembly having a capillary fluid transport system.

According to a further embodiment, the fluid transportation device 32, FIG. 8, may feature one or more capillary tubes 81. The capillary tubes 81 transport the water 14 from the base region 24 to the water delivery assembly 40 and preferably include one or more reservoirs 85 arranged along the height of the waterfall assembly 10 which aid the capillary tubes 81 in transporting the water 14. Each reservoir 85 may be feed by multiple capillary tubes 81. The dimensions of capillary tubes 81 and the reservoirs 85 depend upon the desired flow rate of the water 14 as well as the desired pressure, and are within the knowledge of one of ordinary skill in the art. The waterfall assembly 10 preferably further includes a back drop sheet 83 disposed between fluid transportation device 32 and the internal surface 16. The back drop sheet 83 is preferably non-transparent such that the back drop sheet 83 hides the fluid transportation device 32 while being viewed from the front. In use, the water 14 flows over the internal surface 16 as discussed above and the back drop sheet 83 prevents the fluid transportation device 32 from being seen.

As mentioned above, the present invention is not intended to be limited to a system or method which must satisfy one or more of any stated or implied object or feature of the invention and should not be limited to the preferred, exemplary, or primary embodiment(s) described herein. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the claims when interpreted in accordance with breadth to which they are fairly, legally and equitably entitled.

The invention claimed is:

1. A waterfall assembly comprising:

a first, substantially hermetically sealed chamber adapted to contain a quantity of liquid, said first chamber comprising:

at least one generally planar and substantially vertical member having an internal surface having a width and an external surface;

a lower region configured for holding said quantity of liquid within said hermetically sealed chamber;

at least one fluid transportation device disposed in said lower region and entirely within said first hermetically sealed chamber, wherein said at least one fluid transportation device includes a pump, and wherein said pump is coupled to a plumbing member that is disposed entirely within said first hermetically sealed chamber, said fluid transportation device and said plumbing member configured for transporting said liquid from said lower region to an upper region of said hermetically sealed chamber;

an elongated fluid dispersing member, coupled to said plumbing member, and having a length and a plurality of fluid dispersing apertures disposed generally completely along said length, said plurality of apertures in fluid communication with said at least one fluid transportation device, said elongated fluid dispersing member disposed proximate said upper region of and entirely within said first hermetically sealed chamber, and configured for receiving liquid from said fluid transportation device through said plumbing member and for directing said liquid through each of said plurality of fluid dispersing apertures disposed generally completely along said length of said elongated fluid dispersing member directly against generally said entire width of said internal surface of said substantially vertical side of said first hermetically sealed chamber, such that said directed liquid flows vertically down said internal surface of said substantially vertical member creating a fluid effect; and said first substantially hermetically sealed chamber including a bottom chamber forming member, said bottom chamber forming member constructed of a light transmissive material; and a second, substantially hermetically sealed chamber disposed adjacent said bottom chamber forming member of said first substantially hermetically sealed chamber, and configured for containing a light source, wherein said light source is configured for illuminating at least a region of said first hermetically sealed chamber.

2. The waterfall as claimed in claim 1 wherein said internal surface of said vertical member of said first hermetically sealed chamber includes a plurality of protrusions.

3. The waterfall as claimed in claim 2 wherein said plurality of protrusions are arranged in substantially horizontal rows.

4. The waterfall as claimed in claim 1 wherein said substantially vertical member of said first hermetically sealed chamber is substantially transparent.

5. The waterfall as claimed in claim 1 wherein said substantially vertical member of said first hermetically sealed chamber is substantially translucent.

6. A waterfall apparatus comprising:

a hermetically sealed unit defining a cavity including at least one substantially transparent and vertical side having an internal surface with a plurality of protrusions, said hermetically sealed unit further comprising;

a lower region configured for holding a quantity of liquid within said hermetically sealed unit;

a fluid transportation system, disposed entirely within said hermetically sealed unit, wherein said fluid transportation system includes a pump, disposed in said lower region, and wherein said pump is coupled to a plumbing member that is located entirely within said hermetically sealed unit, said pump and said plumbing member for transporting said liquid from said lower region to an upper region of said hermetically sealed unit; and an elongated fluid dispersing member, fluidly coupled to said plumbing member and said pump, and located entirely within said hermetically sealed unit, said elongated fluid dispersing member having a length and a plurality of fluid dispersing apertures disposed generally completely along said length, said plurality of apertures in fluid communication with said pump, said elongated fluid dispersing member disposed entirely within said hermetically sealed unit and configured for directing said liquid through each of said plurality of fluid dispersing apertures disposed generally completely along said length of said elongated fluid dispersing member directly against generally said entire width of said internal surface with a plurality of protrusions of said substantially vertical side such that said liquid flows across said internal surface from said upper region towards a lower region of said internal surface; and a chamber disposed substantially beneath said hermetically sealed unit, said chamber including a light source and a substantially transparent divider between said chamber and said hermetically sealed unit such that light emitted from said light source passes through said divider, into said cavity, and illuminates at least a portion of said hermetically sealed unit.

7. The waterfall apparatus as claimed in claim 6 wherein said plurality of protrusions disposed on said internal surface are substantially arranged in horizontal rows.

8. The waterfall as claimed in claim 1, wherein said elongated fluid dispersing member has a variable water flow rate.

9. The waterfall as claimed in claim 1 further including at least one mounting bracket for securing said waterfall to a surface.

10. The waterfall as claimed in claim 6, wherein said chamber further includes a cooling device.

11. The waterfall as claimed in claim 6 further including at least one mounting bracket for securing said waterfall to a surface.

* * * * *